United States Patent [19]

Haman et al.

[11] Patent Number: 4,763,760

[45] Date of Patent: Aug. 16, 1988

[54] AUTOMATICALLY FORCED FLUID SUPPLY SYSTEM

[75] Inventors: David F. Haman, Waukegan; Allan F. Miller, Lindenhurst, both of Ill.

[73] Assignee: Outboard Marine Corporation, Waukegan, Ill.

[21] Appl. No.: 902,571

[22] Filed: Sep. 2, 1986

[51] Int. Cl.[4] ..... F01M 1/04

[52] U.S. Cl. ..... 184/6.5; 123/196 R; 74/605

[58] Field of Search ..... 184/6.5; 123/196 R, 123/196 CP; 74/605

[56] References Cited

U.S. PATENT DOCUMENTS

| | | | |
|---|---|---|---|
| 1,890,550 | 4/1932 | Stenglemeir | 74/605 |
| 2,196,422 | 11/1938 | Meyer | 74/605 |
| 2,857,903 | 10/1958 | Watkins | 184/6.5 X |
| 4,466,387 | 10/1983 | Perry | 123/41.37 |
| 4,515,110 | 7/1984 | Perry | 123/41.37 |

FOREIGN PATENT DOCUMENTS

| | | | |
|---|---|---|---|
| 2912476 | 10/1980 | Fed. Rep. of Germany | 123/196 R |
| 911890 | 7/1946 | France | 184/6.5 |
| 2851 | 2/1905 | United Kingdom | 74/605 |
| 144231 | 6/1920 | United Kingdom | 184/11.4 |

*Primary Examiner*—Leonard E. Smith

*Attorney, Agent, or Firm*—Michael, Best & Friedrich

[57] ABSTRACT

Disclosed herein is an automatically forced fluid supply system for lubricating a crankpin in an internal combustion engine of the type wherein lubricant is suspended in a gaseous medium within the engine, the automatically forced fluid supply system comprising a crankpin including an end, an exterior bearing surface, and an interior passageway extending from the end and opening through the bearing surface, and a scoop, adjacent the crankpin end and communicating with the passageway, for intercepting lubricant in response to movement of the crankpin through the gaseous medium having therein the suspended lubricant and for conveying the intercepted lubricant to the interior passageway for distribution onto the bearing surface.

18 Claims, 2 Drawing Sheets

AUTOMATICALLY FORCED FLUID SUPPLY SYSTEM

BACKGROUND OF THE INVENTION

This invention relates generally to internal combustion engines, and more particularly, to an automatically forced fluid supply system for lubricating a crankpin in such an engine.

One technique for lubricating an internal combustion engine involves suspending fluid lubricant in a gaseous medium within the engine housing. In two-cycle, crankcase scavenged, internal combustion engines, lubricating oil is sometimes mixed with fuel to produce a lubricating mist within the engine when the mixture is mixed with air and admitted into the engine crankcase.

Known methods of supplying lubricant to the crankpin bearing in such engines include forming various holes, slots and similar apertures in the crankpin bore of each engine connecting rod. As each connecting rod moves during operation of the engine, lubricant is intercepted and partially retained by the holes and slots. Because the movement of each connecting rod relative to the suspended lubricant is oscillatory in nature, however, lubricant can be forced out of, as well as into, the crankpin bearing when such prior techniques are employed. Inefficient or inadequate lubrication can result.

Attention is directed to the following

| | | |
|---|---|---|
| Perry | 4,515,110 | May 7, 1985 |
| Perry | 4,466,387 | August 21, 1984 |
| Meyer | 2,196,422 | April 9, 1940 |
| Stenglemeir— | 1,890,550 | December 13, 1932 |

Attention is also directed to the following foreign patent:

| | | |
|---|---|---|
| Krupp Akt. | GB 2,851 | February 11, 1905 |

SUMMARY OF THE INVENTION

The invention provides an automatically forced fluid supply system for lubricating the crankpin in an internal combustion engine of the type wherein lubricant is suspended in a gaseous medium within the engine, the automatically forced fluid supply system comprising a crankpin including an end, an exterior bearing surface, and an interior passageway extending from the end and opening through the bearing surface, and scoop means adjacent the end and communicating with the passageway for intercepting lubricant in response to movement of the crankpin through the gaseous medium having therein the suspended lubricant and for conveying the intercepted lubricant to the interior passageway for distribution onto the bearing surface.

The invention also provides an automatically forced fluid supply system for lubricating a crankpin in an internal combustion engine of the type wherein lubricant is suspended in a gaseous medium within the engine, the automatically forced fluid supply system comprising an elongate crankpin including first and second ends, an exterior bearing surface, and an interior passageway extending from the first and second ends and opening through the bearing surface, the automatically forced fluid supply system further comprising first scoop means carried at the first end and communicating with the interior passageway for intercepting lubricant in response to movement of the elongate crankpin through the suspended lubricant and for communicating the intercepted lubricant to the interior passageway for distribution onto the bearing surface, and second scoop means, carried at the second end and communicating with the interior passageway, for intercepting lubricant in response to movement of the elongate crankpin through the suspended lubricant, and for communicating the intercepted lubricant to the interior passageway for distribution onto the bearing surface.

The invention also provides an automatically forced fluid supply system for lubricating a crankpin in an internal combustion engine of the type wherein lubricant is suspended in a gaseous medium within a crank housing, the automatically forced fluid supply system comprising a crankshaft mounted within the crank housing for rotation around a rotational axis, a substantially cylindrical hollow crankpin oriented substantially parallel to the rotational axis and carried on the crankshaft at a point radially offset from the rotational axis and including an end, a sidewall, and an opening in the side wall at a point most radially distant from the rotational axis, the automatically forced fluid supply system further comprising a scoop adjacent the end of the crankpin and communicating with the interior of the crankpin for intercepting the suspended lubricant when the crankshaft is rotated within the crank housing and for conveying the intercepted lubricant into the interior of the hollow crankpin for distribution through the opening onto the exterior of the crankpin.

In one embodiment, the crankpin has a longitudinal axis and the interior passageway includes an axial passageway portion, extending substantially along the longitudinal axis from the end, and a radial passageway portion oriented substantially perpendicularly to the axial portion and opening through the exterior bearing surface.

In one embodiment, the interior passageway includes a plurality of radial passageway portions.

In one embodiment, the radial portion of the interior passageway opens through the exterior bearing surface at a point most radially distant from the rotational axis.

In one embodiment, the scoop means comprises a hood defining an opening facing in the direction of rotary movement of the crankpin.

In one embodiment, the hood includes an interior surface for intercepting and diverting lubricant into the interior passageway in response to crankpin rotation.

In one embodiment, the scoop means includes a pair of hoods mounted at opposite ends of the crankpin.

Various other features of the invention will become apparent to those skilled in the art upon review of the following detailed description, claims, and drawings.

Figure 1:
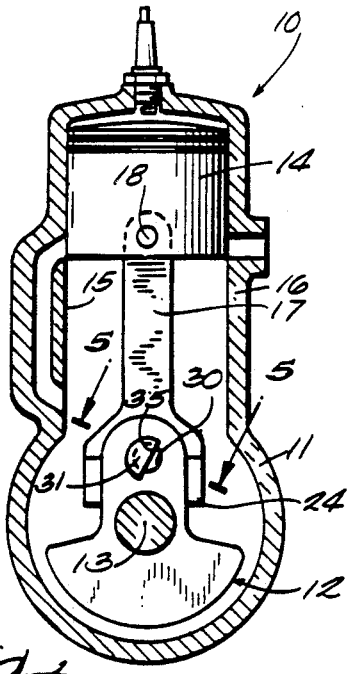
FIG. 1 is a vertical cross-sectional view of a two-cycle, crankcase scavenged, internal combustion engine having an automatically forced fluid supply system.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Referring to the drawings, and in particular to FIG. 1, an internal combustion engine 10, of the type wherein lubricant is suspended in a gaseous medium within the engine, is illustrated. For purposes of this description, engine 10 is a crankcase scavenged, two-cycle engine, although it will be appreciated that the invention is suitable for use with engines of a different type.

As best shown in FIGS. 1 through 4, engine 10 includes a crankcase or crank housing 11 and a crankshaft 12, having a pair of crank-disks 12*a* and 12*b*, mounted within the crank housing 11 for rotation around a rotational axis 13. Power for rotating crankshaft 12 is developed by a generally cylindrical piston 14 mounted for reciprocation within a circular cylinder bore 15 formed in a cylinder housing 16 disposed adjacent, and joined with, crank housing 11. Reciprocation of piston 14 within bore 15 is translated into rotation of crankshaft 12 by means of a connecting rod 17 joining the piston with the crankshaft. A wrist pin 18, extending through the upper end of connecting rod 17 and the skirt of piston 14, allows the connecting rod to pivot relative to the piston.

Figure 5:
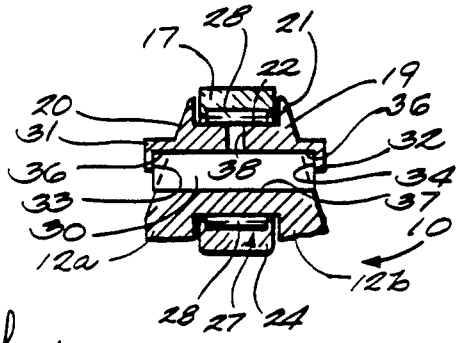
FIG. 5 is a cross-sectional view of the engine shown in FIG. 1, taken along line 5—5 thereof.
Figure 4:
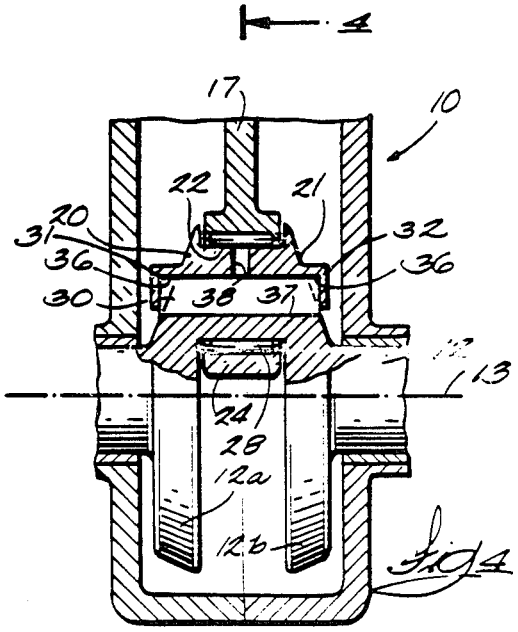
FIG. 4 is a cross-sectional view of the engine shown in FIG. 3 taken along line 4—4 thereof.
Figure 6:
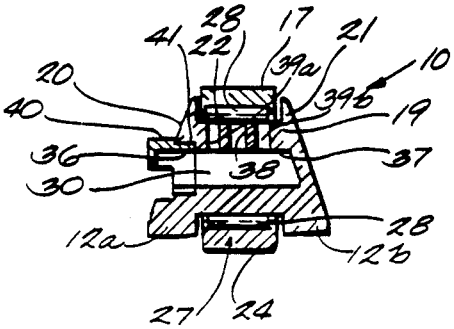
FIG. 6 is a cross-sectional view, similar to FIG. 4, showing an alternate embodiment of the invention.

To provide a rotatable coupling between connecting rod 17 and crankshaft 12, a substantially cylindrical crankpin 19 (FIG. 3) is carried on the crankshaft between crank-disks 12*a* and 12*b* at a point radially offset from rotational axis 13. Crankpin 19 is oriented so as to be substantially parallel to rotational axis 13 and, as best seen in FIGS. 4, 5 and 6, includes a pair of opposed ends 20 and 21. A generally cylindrical bearing surface 22 is defined along the exterior of crankpin 19 between crankpin ends 20 and 21. A crankpin bore 23 is formed in the lower end of connecting rod 17 and is dimensioned to receive and encircle crankpin 19. Connecting rod 17 is preferably cut along a line extending diametrically across the crankpin bore 23 to form a removable end cap 24 which is joined to the remainder of the connecting rod by means of a pair of bolts 25 and 26. However, a one piece connecting rod can serve equally well. To reduce friction, a crankpin roller bearing 27, comprising a plurality of spaced parallel rollers 28, is preferably disposed between bearing surface 22 and the interior surface of crankpin bore 23.

To provide internal engine lubrication, lubricant in the form of oil 29 is suspended in a gaseous medium (air) within crank housing 11. Preferably, the oil is added to the engine fuel to form a fuel/oil mixture which, during upward movement of piston 14, is drawn through a carburetor (not shown), mixed with air, and then drawn into crank housing 11. During engine operation, the suspended lubricant partially condenses to form a lubricating film on various bearing surfaces within crank housing 11 and cylinder housing 16.

To improve the lubrication of the crankpin roller bearing 27, crankpin 19 is preferably hollow to form an interior passageway 30 therein. Passageway 30 extends from at least one of the opposed crankpin ends 20 or 21 and opens through the bearing surface 22. In addition, scoop means are provided for intercepting lubricant in response to movement of the crankpin through the gaseous medium having therein the suspended lubricant and for conveying the intercepted lubricant to the interior passageway 30 for distribution onto the bearing surface 22. While various suitable scoop means can be used, in the illustrated construction, the scoop means comprises a pair of hoods 31 and 32 (FIG. 5) mounted adjacent crankpin ends 20 and 21 respectively. Hoods 31 and 32 each define an opening 33 and 34 facing in the direction of rotary movement of the crankpin and function to intercept and divert lubricant into passageway 30 upon rotation of crank shaft 12. It will be appreciated that the particular orientation of the opening with respect to the direction of rotary movement of the crankpin is not critical, and it is sufficient that the orientation be such that lubricant be intercepted and diverted into passageway 30 during rotation of the crankshaft 12.

Figure 2:
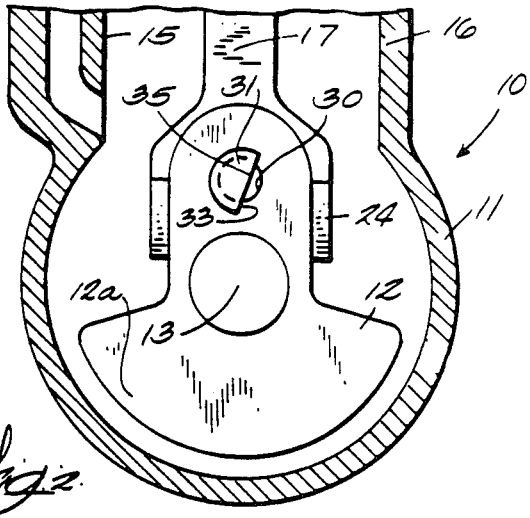
FIG. 2 is an enlarged, partial, vertical, cross-sectional view of the engine shown in FIG. 1.
Figure 3:
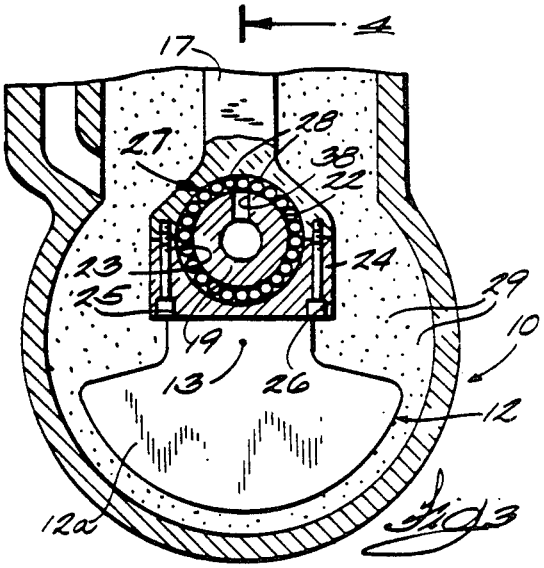
FIG. 3 is an enlarged, partial, vertical, cross-sectional view, similar to FIG. 2, showing in detail a crankpin, a crankpin bearing and the automatically forced fluid supply system.

As best shown in FIGS. 1, 2 and 5, hoods 31 and 32 each comprise a partially cylindrical, hollow protuberance extending outwardly from each crankpin end 20 and 21 along the longitudinal axis of the crankpin. It will be appreciated, however, that the hoods need not be cylindrical in order to perform effectively and that other shapes can be used. As viewed in FIGS. 1 and 2, the boundary of opening 33 defines a chord line 35 across the circular cross-section of hood 31. Opening 34 in hood 32 is similarly formed. An interior surface 36, on which intercepted lubricant is collected in response to crankshaft rotation, is formed within each hood and along passageway 30. Preferably, crank shaft 12, crankpin 19, and hoods 31 and 32 are integrally formed as a single unit.

To enhance the collection of lubricant within interior passageway 30, openings 33 and 34 in hoods 31 and 32 preferably face in the same direction. Thus, during engine operation, each hood functions to force the fuel/oil and air mixture into passageway 30 from both ends in response to rotation of crankshaft 12. Lubricant is thus positively intercepted and diverted into interior passageway 30 and, by reason of centrifugal force, collects in the portion of the passageway which is most radially distant from rotational axis 13.

To facilitate distribution of the lubricant onto bearing surface 22 and into crankpin roller bearing 27, passageway 30 preferably includes an axial passageway portion 37 extending along the longitudinal axis of crankpin 19 and a radial passageway portion 38 extending substantially perpendicularly to axial passageway portion 37. Preferably, radial passageway portion 38 is located substantially midway between crankpin ends 20 and 21 and opens through bearing surface 22 at a point most radially distant from rotational axis 13. Although, in the figures, a distinctly elongate passageway is shown, it will be appreciated that the radial passageway portion 38 can comprise a hole, slot or other such opening in the sidewall of the crankpin and can open through the bearing surface at a point other than one most radially distant from rotational axis 13. Similarly, one or more additional radial passageways or openings can be included.

An alternate embodiment of the invention is illustrated in FIG. 6. In this embodiment, the axial passageway portion 37, while continuing to open through crankpin end 20, does not extend fully through crankpin 19 and is thus closed adjacent crankpin end 21. Radial passageway portion 38 continues to open through bearing surface 22 and a pair of optional, additional radial passageways 39*a* and 39*b* are included. The additonal passageways 39*a* and 39*b* are positioned so as to improve the distribution of lubricant onto bearing surface 22 and can, for example, be positioned between passageway 38 and the crankpin ends 20 and 21. The hood adjacent crankpin end 21 has been eliminated and hood 31, which in the earlier-described embodiment was integrally formed with crankpin 19, is replaced by a separate and detachable hood member 40. Detachable hood member 40 is substantially similar to the previously described integrally formed hoods 31 and 32 in shape, dimension and function, but, as illustrated, is provided, adjacent one end, with a reduced diameter skirt 41 which is received in the open end of axial passageway portion 37. Mounting of detachable hood 40 to crankpin 19 is preferably accomplished by means of a press-fit, although it will be appreciated that other fastening means, such as screw threads, can be successfully employed. It will also be appreciated that the detachable hood 40 is well-suited for use with the two-hood embodiment of FIGS. 1 through 5, and that the optional, additional radial passageway portion(s) 39*a* and 39*b* can be included with, or deleted from, either embodiment.

Upon rotation of crankshaft 12, the hoods 31, 32 or 40 intercept some of the suspended lubricant 29 present within crank housing 11. By reason of the direction in which the hoods face, a pressure, tending to divert and force the intercepted lubricant into the interior passageway 30 is developed. Because hoods 31 and 32, as previously noted, each face in the same direction, fluid flow at each end of the crankpin is directed toward the interior of the crankpin and out radial passageway portion 38. This, combined with the centrifugal force developed in response to crankshaft rotation, causes the intercepted lubricant to flow outwardly through radial passageway portion 38 and onto bearing surface 22. Similarly, in the single hood embodiment shown in FIG. 6, the resulting forces force lubricant outwardly through radial passageway portions 38, 39*a* and 39*b*. The arrangement of either embodiment provides more positive flow of lubricant to the crankpin bearing than is possible with prior arrangements wherein lubricant back-flow can occur during portions of the crank shaft rotational cycle.

Figure 7:
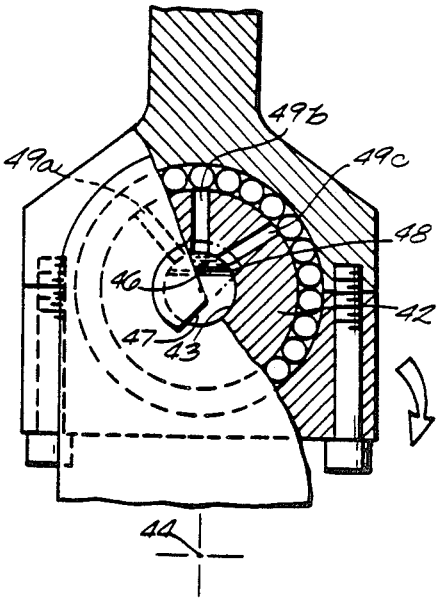
FIG. 7 is a diagrammatic view useful in understanding the operation of the automatically forced fluid supply system.

The principle of operation of the invention can best be understood by reference to FIG. 7. As illustrated, the system includes a crankpin 42 having a hollow interior 43 positioned for orbital movement around a center of rotation 44. Liquid lubricant 46, accumulated by one or more fluid accumulating hoods 47 communicating with the crankpin interior 43, collects within the crankpin interior and, by virtue of the centrifugal force developed as the crankpin 42 rotates around the center of rotation 44, puddles along the portion of the crankpin interior 43 most radially distant from the center of rotation 44. As illustrated, the level of the accumulated lubricant 46 will rise until it reaches a level at which a path of escape is provided. For example, as illustrated in FIG. 7, the fluid level will rise until it reaches a corner 48 defined at the juncture of the open portion of the hood 47 and the crankpin interior 43.

To permit the accumulated lubricant 46 to flow outwardly onto the exterior bearing surface of crankpin 42, one or more fluid passageways 49*a*, 49*b* and 49*c* are provided. To assure positive fluid flow from the crankpin interior 43, each of the fluid passageways 49*a*, 49*b* and 49*c* opens into the crankpin interior 43 at a point which will normally be located beneath the surface of the accumulated lubricant 46.

Figure 8:
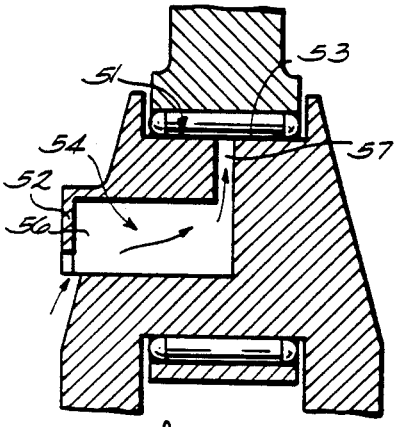
FIG. 8 is a cross-sectional view, similar to FIG. 6, showing an alternate embodiment of the invention.
Figure 9:
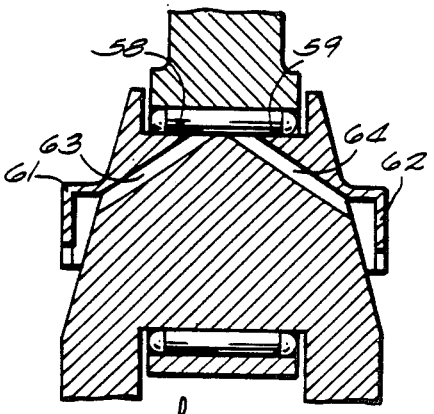
FIG. 9 is a cross-sectional view, similar to FIG. 8, showing an alternate embodiment of the invention.
Figure 10:
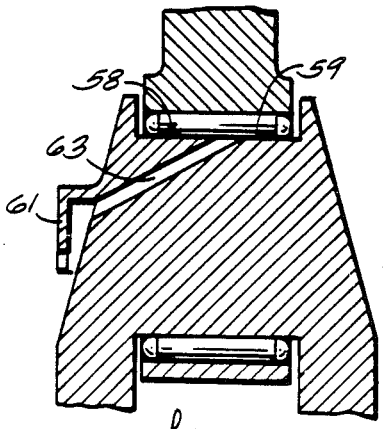
FIG. 10 is a cross-sectional view, similar to FIG. 9, showing an alternate embodiment of the invention.

Additional alternative embodiments of the invention are illustrated in FIGS. 8, 9 and 10. In FIG. 8, a crankpin 51 includes an integrally formed fluid accumulator hood 52, an exterior bearing surface 53 and an interior passageway 54 extending between the accumulator hood 52 and the bearing surface 53. As illustrated, the interior passageway 54 includes an axial portion 56 extending parallel to the length of the crankpin 51 and a radial portion 57 extending perpendicularly to the axial portion 56 and opening through the bearing surface 53.

In FIG. 9, a crankpin 58, having an exterior bearing surface 59, includes, at its opposite ends, a pair of integrally formed accumulator hoods 61 and 62 respectively. In contrast to the earlier described embodiments, fluid accumulated by each of the hoods 61 and 62 is conveyed to the exterior bearing surface 59 through individual interior conduits 63 or 64 respectively. Additionally, each of the conduits extends from its respective hood substantially directly toward the exterior bearing surface 59 and hence does not include distinct radial and axial portions. This exemplifies the fact that the particular shape and orientation of the fluid conduits is not critical and that proper operation of the automatically forced fluid supply system requires only that the conduits be formed so as to convey accumulated fluid from the interior of the crankpin to the bearing surface 59.

The embodiment illustrated in FIG. 10 is substantially similar to that of FIG. 9 and differs in that only one fluid accumulator hood 61 and fluid conduit 63 is provided. Again, the particular configuration of the fluid conduit 63 is not critical.

Various other features and advantages of the invention are set forth in the following claims.

We claim:

1. An automatically forced fluid supply system for lubricating a crankpin in an internal combustion engine of the type wherein lubricant is suspended in a gaseous medium within the engine, said automatically forced fluid supply system comprising a crankpin including an end surface, an exterior bearing surface, and an interior passageway extending from said end surface and opening through said bearing surface, and a hood projecting axially outwardly adjacent said end surface, communicating with said interior passageway, and defining an opening located axially outwardly of said end surface and facing in the direction of rotary movement of said crankpin for intercepting lubricant located axially outwardly of said end surface in response to movement of said crankpin through the gaseous medium having therein the suspended lubricant and for conveying the intercepted lubricant to said interior passageway for distribution onto said bearing surface.

2. An automatically forced fluid supply system according to claim 1 wherein said hood includes an interior surface for intercepting and diverting lubricant into said interior passageway in response to crankpin rotation.

3. An automatically forced fluid supply system according to claim 1 wherein said crankpin has a second end opposite said first mentioned end and further including a second hood adjacent said second end and communicating with said interior passageway for intercepting lubricant in response to movement of said crankpin through the gaseous medium having therein the suspended lubricant and for conveying the intercepted lubricant to said interior passageway for distribution onto said bearing surface.

4. An automatically forced fluid supply system according to claim 1 wherein said crankpin has a longitudinal axis and wherein said interior passageway includes an axial portion extending substantially along said longitudinal axis from said end and a radial portion oriented substantially perpendicularly to said axial portion and opening through said exterior bearing surface.

5. An automatically forced fluid supply system according to claim 4 wherein said interior passageway includes a plurality of said radial portions.

6. An automatically forced fluid supply system according to claim 4 wherein said crankpin is mounted for rotation around a rotational axis and is oriented such that said longitudinal axis is substantially parallel to, and radially offset from, said rotational axis.

7. An automatically forced fluid supply system according to claim 6 wherein said radial portion of said interior passageway opens through said exterior bearing surface at a point most radially distant from said rotational axis.

8. An automatically forced fluid supply system according to claim 7 wherein said interior passageway includes a plurality of said radial portions.

9. An automatically forced fluid supply system for lubricating a crankpin in an internal combustion engine of the type wherein lubricant is suspended in a gaseous medium within the engine, said automatically forced fluid supply system comprising an elongate crankpin including first and second end surfaces, an exterior bearing surface, and an interior passageway extending from said first and second end surfaces and opening through said bearing surface, said automatically forced fluid supply system further comprising a first hood projecting axially outwardly from said first end surface, communicating with said interior passageway, and defining a first opening located axially outwardly of said first end surface and facing in the direction of rotary movement of said crankpin for intercepting lubricant in response to movement of said elongate crankpin through the suspended lubricant located axially outwardly of said first end surface and for conveying the intercepted lubricant to said interior passageway for distribution onto said bearing surface, and a second hood projecting axially outwardly from said second end surface, communicating with said interior passageway, and defining a second opening located axially outwardly of said second end surface and facing in the direction of rotary movement of said crankpin for intercepting lubricant located axially outwardly of said second end surface in response to movement of said elongate crankpin through the suspended lubricant and for conveying the intercepted lubricant to said interior passageway for distribution onto said bearing surface.

10. An automatically forced fluid supply system according to claim 9 wherein said hood includes an interior surface for intercepting and diverting lubricant into said interior passageway in response to crankpin rotation.

11. An automatically forced fluid supply system according to claim 9 wherein said crankpin has a longitudinal axis and wherein said interior passageway includes an axial portion extending substantially along said longitudinal axis between said first and second ends, and a radial portion oriented substantially perpendicularly to said axial portion and opening through said exterior bearing surface.

12. An automatically forced fluid supply system according to claim 11 wherein said interior passageway includes a plurality of said radial portions.

13. An automatically forced fluid supply system according to claim 11 wherein said crankpin is mounted for rotation around a rotational axis and is oriented such that said longitudinal axis is substantially parallel to, and radially offset from, said rotational axis.

14. An automatically forced fluid supply system according to claim 13 wherein said radial portion of said interior passageway opens through said exterior bearing surface at a point most radially distant from said rotational axis.

15. An automatically forced fluid supply system according to claim 14 wherein said interior passageway includes a plurality of said radial portions.

16. An automatically forced fluid supply system for lubricating a crankpin in an internal combustion engine of the type wherein lubricant is suspended in a gaseous medium within a crank housing, said automatically forced fluid supply system comprising a crankshaft mounted within the crank housing for rotation around a rotational axis, a substantially cylindrical crankpin oriented substantially parallel to said rotational axis and carried on said crankshaft at a point radially offset from said rotational axis and including an end surface extending generally transversely to said rotational axis, a hollow interior, a side wall, and an opening in said side wall at a point most radially distant from said rotational axis, said automatically forced fluid supply system further comprising a scoop comprising a hood projecting axially outwardly of said end surface of said crankpin, communicating with said interior of said crankpin, and defining an opening located axially outwardly of said end surface and facing in the direction of rotation of said crankshaft for intercepting the suspended lubricant located axially outwardly adjacent said end surface when said crankshaft is rotated within the crank housing and for conveying the intercepted lubricant into said interior of said crankpin for distribution through said opening onto said side wall of said crankpin.

17. An automatically forced fluid supply system according to claim 16 wherein said crankshaft includes a second end opposite said first mentioned end and further including a second hood adjacent said second end of said crankpin and communicating with said interior of said crankpin for intercepting the suspended lubricant when said crankshaft is rotated Within the crank housing and for conveying the intercepted lubricant into said interior of said crankpin for distribution through said opening onto said side wall of said crankpin.

18. An automatically forced fluid supply system according to claim 10 wherein said crankpin includes a plurality of said openings in said sidewall.

* * * * *